United States Patent [19]

Nakagawa et al.

[11] Patent Number: 4,742,344

[45] Date of Patent: May 3, 1988

[54] DIGITAL DISPLAY SYSTEM WITH REFRESH MEMORY FOR STORING CHARACTER AND FIELD ATTRIBUTE DATA

[75] Inventors: Banri Nakagawa, Yamato; Katsuyuki Nojima, Yokohama, both of Japan

[73] Assignee: International Business Machines Corp., Armonk, N.Y.

[21] Appl. No.: 802,417

[22] Filed: Nov. 27, 1985

[30] Foreign Application Priority Data

Dec. 20, 1984 [JP] Japan ..... 59-267638

[51] Int. Cl.[4] ..... G09G 1/16

[52] U.S. Cl. ..... 340/723; 340/703; 340/750; 340/790

[58] Field of Search ..... 340/750, 703, 723, 748, 340/744, 798, 799, 735, 790

[56] References Cited

U.S. PATENT DOCUMENTS 4,404,554 9/1983 Tweedy, Jr. et al. ..... 340/750

4,646,077 2/1987 Culley ..... 340/750

*Primary Examiner*—Marshall M. Curtis

[57] ABSTRACT

A digital display system includes a refresh store containing character data for display on a raster scan video display device and field attribute data defining attributes of fields of the character data. The character data is stored as character bytes in sequential locations in the store for readout in groups to provide respective rows of displayed characters. The field attribute data comprises attribute bytes interspersed with the character bytes. Character bytes in a group read out following an attribute byte provide displayed characters with an attribute defined by that attribute byte until another attribute byte is accessed in the group. In order to maintain an attribute from one row of displayed characters to the next, the group of character bytes corresponding to the next row requires a copy attribute byte at the start of readout of that group. Instead of being stored with the character bytes, the copy attribute bytes are stored in a separate table in the refresh store, each entry of which contains a copy attribute byte for the start of a corresponding row of displayed characters.

6 Claims, 4 Drawing Sheets

FIG. 4
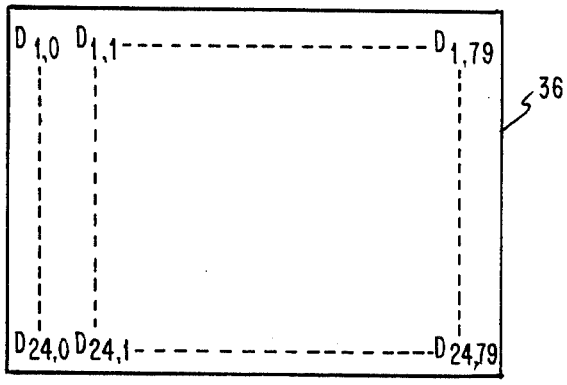
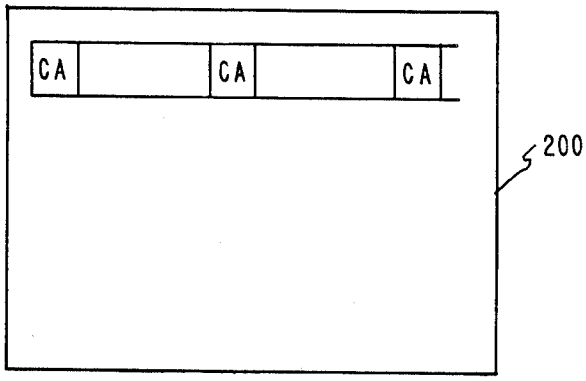
FIG. 5

DIGITAL DISPLAY SYSTEM WITH REFRESH MEMORY FOR STORING CHARACTER AND FIELD ATTRIBUTE DATA

DESCRIPTION

1. Technical Field

The present invention relates to digital display system, and in particular to such systems which employ a refresh memory to store data for display.

2. Background to the Invention

Memory display systems provide, in addition to character display data, attribute data. This attribute data is used in combination with the character display data to determine the form of displayed characters. The attribute data may be used to generate flashing characters, reverse video characters, highlighted characters, or to modify the color of characters. In some systems each character is accompanied by attribute data, in others, an attribute byte, termed a field attribute byte, is used to determine the characteristic of a field of characters. In prior art systems, such as that shown in U.S. Pat. No. 4,278,973 (Hughes et al), when such a field of characters extends beyond one line of a display, the field attribute byte last used in one line is copied into the initial location in the refresh memory of the next line of characters in the field, so that the displayed line will at least initially have the same attribute. When the display is partitioned or windowed, as is shown in Hughes et al, this initial location is the initial location of the next line of the same partition or window. FIG. 5 shows the prior art arrangement in simplified form wherein each data group corresponding to a character line, either a full display line or a line in a partition, is separated from the next line by an attribute copy byte CA. The problem with these prior art systems is that searching, deletion and invention of the character data is complicated by the attribute copy bytes resulting in a decrease in data processing efficiency.

It is an object of the invention to provide a digital display system having a refresh memory storing character data and field attribute data using an arrangement in which data processing efficiency can be increased with respect to prior art systems.

DISCLOSURE OF THE INVENTION

The present invention relates to a digital display system including a refresh memory for storing character data for display on a raster scan video display device and field attribute data defining attributes of fields of displayed characters. In addition to field attribute data stored within the character data area, an attribute copy table stores copy field attribute data for the start of each row of display characters, and this table is referenced at the start of display of each row of characters. Each copy field attribute data group is copied from the field attribute data applied to the end of the previous display row of characters.

BRIEF DESCRIPTION OF THE DRAWINGS

FIG. 4 illustrates the layout of character data in the refresh memory of FIG. 1.

FIG. 5 shows a prior art layout of copy attribute data in a display system refresh memory.

BEST MODE FOR CARRYING OUT THE INVENTION

Figure 1:
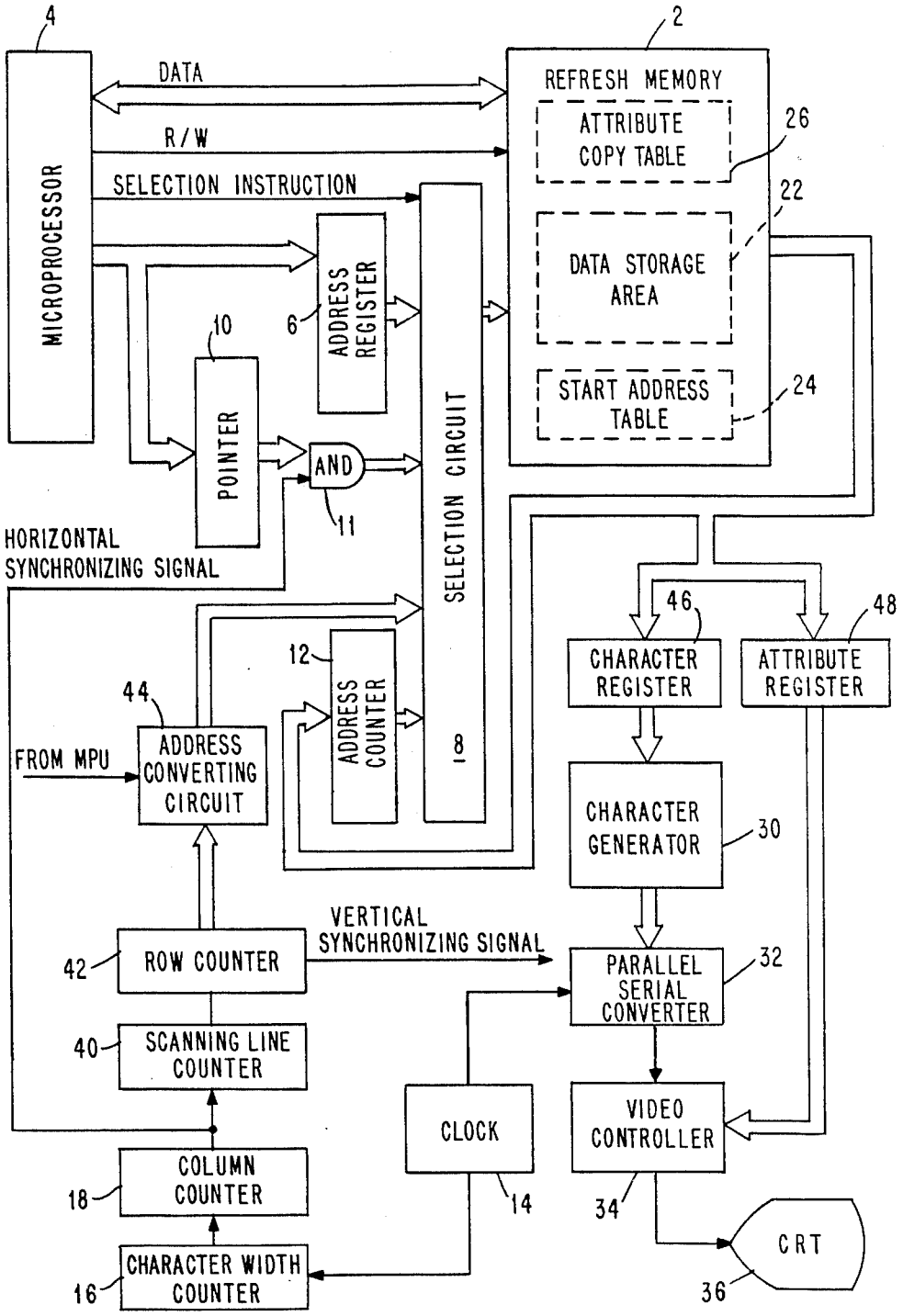
FIG. 1 is a block diagram of an embodiment of the invention.

FIG. 1 shows an embodiment of a display device embodying the present invention. In FIG. 1, refresh memory 2 is a random access memory comprising a data storage area 22 which stores character bytes to be displayed and field attribute bytes, a start address table 24 which stores start addresses of each row of this data storage area 22 (here, a row does not mean the actual row of the memory but the storage area corresponding to the row of the screen) in desired sequence, and an attribute copy table 26 which stores attribute copy signals defining the display condition of characters in each row of the data storage area 22 in desired sequence (the same sequence as that of the start address).

Figure 2:
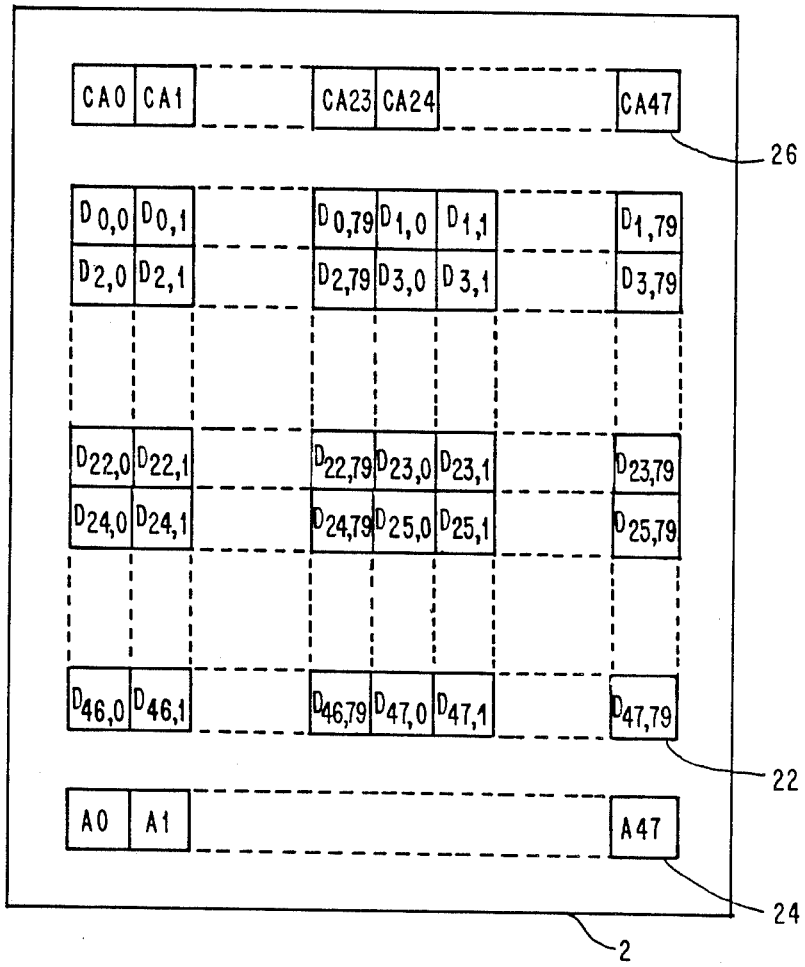
FIG. 2 shows the layout of data in the refresh memory of FIG. 1.

FIG. 2 shows the configuration of the refresh memory 2 in detail. The data storage area 22 has a capacity to store data for two CRT screen displays. In this embodiment, the CRT screen displays 24 rows each of which consists of 80 characters. Data in row 0 of the data storage area 22 comprises $D_{0,0}$, $D_{0,1}$, through $D_{0,79}$; data in row 1 comprises $D_{1,0}$, $D_{1,1}$, through $D_{1,79}$, and so on with data in row 47 comprising $D_{47,1}$, through $D_{47,79}$. The start address table 24 stores start addresses of 48 rows in the data storage area 22 in a desired sequence. For convenience of description, the start address table 24 is assumed to store start addresses of rows in the same sequence as the rows of the data storage area 22. That is, the stored information A0 of the first address in the start address table 24 is the start address of the row that that stores data from $D_{1,0}$ to $D_{1,79}$ and the stored information A47 of the last address is the start address of the row that stores data from $D_{47,0}$ to $D_{47,79}$.

The attribute copy table 26 has 48 sequentially addressable memory locations corresponding to the 48 rows in data storage area 22. The attribute copy byte CA0 stored in the first memory location of the attribute copy table 26 defines the display condition of data $D_{0,0}$ to $D_{0,79}$ in row 0 of the data storage area 22 (if a field attribute byte is contained within the line, the display condition of the following data (characters) in the line is defined by this field attribute byte). The attribute copy byte CA47 stored in the last memory location defines the display condition of data $D_{47,0}$ to $D_{47,79}$ in row 47 of the data storage area 22 which, as indicated above, may be changed by a field attribute byte contained within the row.

Figure 3:
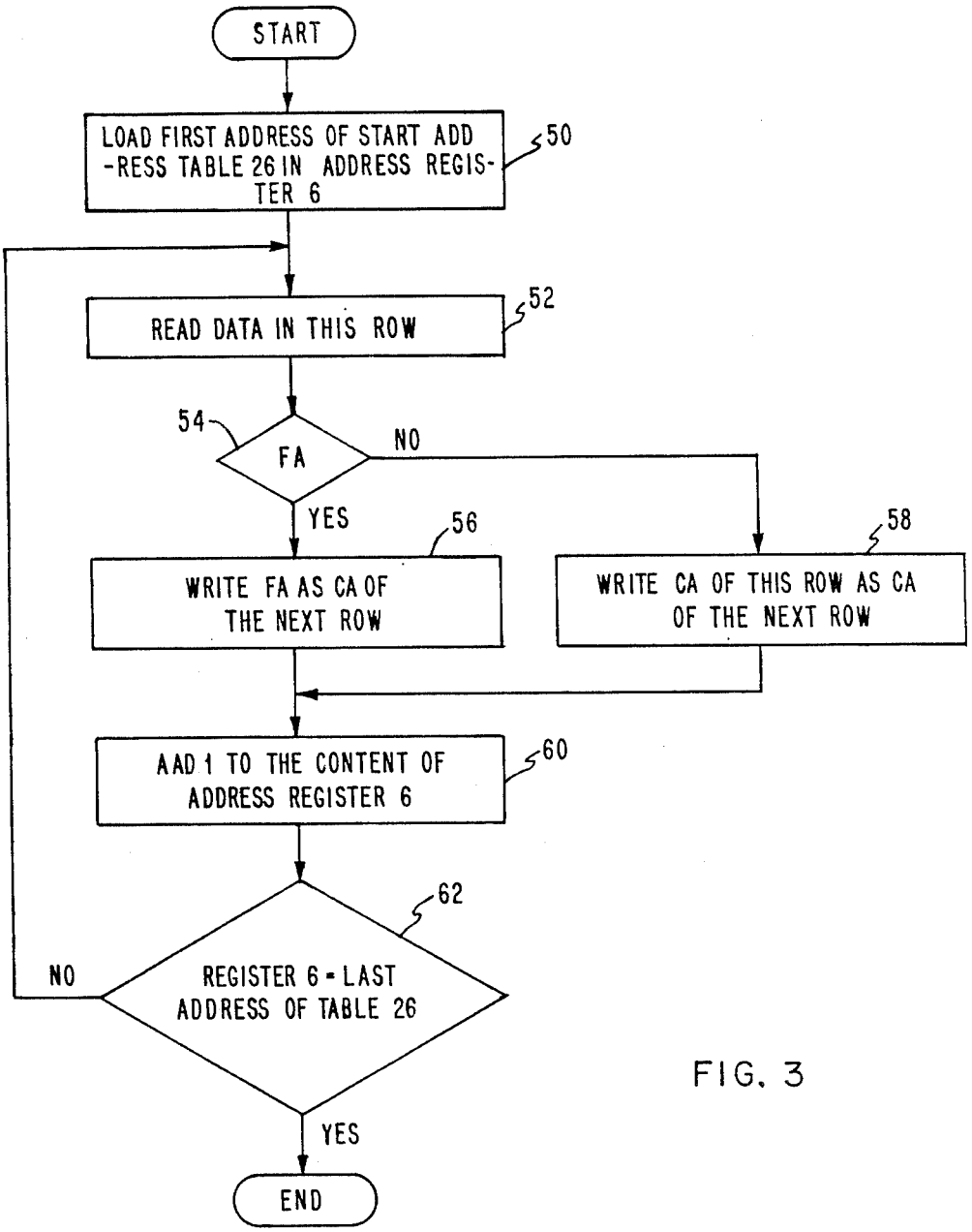
FIG. 3 is a flow diagram illustrating the steps for entering data into the attribute copy table of the refresh memory of FIG. 1.

Referring next to FIGS. 1 and 3, generation of the attribute copy table 26 will be described. First, microprocessor 4 establishes the area which is to be occupied by the attribute copy table in the refresh memory 2, in this embodiment, from address 0 to address 47. This area contains a plurality of sequentially addressable memory locations. Next, microprocessor 4 issues a read instruction to refresh memory 2, and, as is shown in Step 50 of FIG. 3, the microprocessor 4 loads the first address of the start address table 24 into an address register 6 and instructs the selection circuit 8 to transmit the content of address register 6 to the refresh memory 2, thereby the start address A0 of the row 0 of the data storage area 22 is read out of the first address location of the start address table 24, and is set into address counter 12. Microprocessor 4 then instructs the selection circuit 8 to transmit the content of the address counter 12 to the refresh memory 2, whereby the data $D_{0,0}$ in the first memory location of the row 0 in the data storage area 22 is transmitted to the microprocessor 4. Then, the remaining data in the row 0 is sequentially transmitted to the microprocessor 4 as the address counter 12 is incremented (Step 52). The microprocessor 4 tests whether or not a field attribute byte FA is present in the data in the row 0 (Step 54), and if it is present, the microprocessor 4 writes this field attribute byte FA as the attribute copy byte CA of the following row (Step 56). If the field attribute byte FA is absent, the microprocessor 4 writes the attribute copy byte CA0 of this row as the copy attribute byte CA1 of the following line (Step 58). This write operation is achieved by loading the address register 6 with address 1, which is the memory location of the attribute copy byte CA1, from the microprocessor 4, instructing selection circuit 8 to pass the content of the address register 6 to refresh memory 2, issuing a write instruction to refresh memory 2 and transmitting a detected field attribute byte FA or an attribute copy byte CA0 in row 0 to refresh memory 2 through the bus. Usually a byte indicating no attribute is written as the attribute copy byte CA0 corresponding to the start of row 0.

Next, address register 6 is loaded with the following address in the start address table 26 (Step 60), and the data in the row 1, $D_{1,0}$ to $D_{1,47}$, is tested to determine whether it contains a field attribute byte FA. If a field attribute is detected, it is written as the attribute copy byte CA2 of the row 2, if it is not detected, the attribute copy byte CA1 of line 1 is written as the attribute copy byte CA2. By repeating these operations on the data through to last row, $D_{47,0}$ to $D_{47,79}$ (Step 62), the attribute copy table 26 is completed.

The address counter 12 increases the count in accordance with the output pulse of a character width counter 16 which counts reference pulses generated by a clock 14 and outputs pulses during every character scanning of the CRT 36. In this embodiment, a character box consists of $9\times12$ dots, so counter 16 counts from 0 to 8 cyclically to provide an output pulse for each character. A column counter 18 counts the output pulses of the character with counter 16 and outputs a pulse in every scanning line. Counter 18 counts from 0 to 79 cyclically to provide a horizontal synchronizing signal at the start of each scanning line. This signal is applied to one terminal of an AND gate 11, which receives, at its other terminal the output of a pointer 10. Pointer 10 is supplied with the address of the start address table 24 from microprocessor 4 during display. The output terminal of AND gate 11 is connected to the selection circuit 8. The content of pointer 10 is passed to the refresh memory 2 as an address signal only when AND gate 11 receives a horizontal synchronizing signal and selection circuit 8 receives a selection instruction from the microprocessor 4 selecting the output of AND gate 11 as the address for memory 2. A scannng line counter 40 counts the output pulses of the column counter 18 and generates a pulse for eachin character line display of the CRT 36. Counter 40 counts from 0 to 11 cyclically. A row counter 42 counts the output pulses of the scanning line counter 40 and generates a vertical synchronizing signal for each display frame of the CRT 36. Counter 42 counts from 0 to 23 cyclically.

The counts of row counter 42 are used to generate the address of the attribute copy table 26 during display. The first reason for this is that the counts of the row counter 42 can be used to generate 24 sequential memory locations of the attribute copy table 26 during a display frame. The second reason is that since the change in the counts of row counter 42 occurs immediately after the beam of the CRT 36 reaches the right edge of the picture and here is considerable time before the beam returns to the left edge of the picture, the attribute copy byte can easily be read before the display data is read out of data storage area 22 if the counts of row counter 42 are used to generate the address of the attribute copy table 26. The content of row counter 42 is supplied to the selection circuit 8 through an address converting circuit 44. The address converting circuit 44 converts the count output from row counter 42 in accordance with instructions from the microprocessor (MPU) 4, and transmits the result to the selection circuit 8 as the address of the attribute copy table 26. When the memory locations of the attribute copy bytes to be read are from address 0 through address 23, the address converting circuit 44 transmits the count output from the row counter 42 to the selection circuit 8 without any conversion. When the memory locations of the copy attribute bytes to be read are from address 24 through address 47, the microprocessor 4 instructs the address converting circuit 44 to add 24 to the counts of the row counter 42, and the address converter circuit 44 transmits values 24 through 47 to the selection circuit 8.

A character register 46 stores bytes read from memory 2 representing characters to be displayed. An attribute register 48 stores attribute copy bytes read from the attribute copy table 26 or field attribute bytes read from the data storage area 22. A character generator 30 generates the dot patterns of characters corresponding to character bytes stored in the character register 46, and these patterns are converted to serial data by a parallel-serial converter 32 and transmitted to a video controller 34. The video controller 34 modifies patterns from the converter 32 in accordance with the content of the attribute register 48 and transmits them to the CRT 36.

The display operation of the embodiment shown in FIG. 1 will now be described. It is assumed that data from row 1 to row 24 stored in the data storage area 22 is to be displayed on the CRT 36. First, microprocessor 4 instructs the address converter circuit 44, when row 23 is displayed during a previous display frame, to add "1" to the count output from the row counter 42 thereafter. When the previous display frame ends and the count of the row counter 42 becomes 0, the address converting circuit 44 adds 1 to the count of the row counter 44, and transmits "1" to the selection circuit 8. At this time, the selection circuit 8 receives an instruction from the microprocessor 4 to transmit the output of the address converting circuit 44 to the refresh memory 2, so that "1" is transmitted to the refresh memory 2 as an address signal, whereby the attribute copy byte CA1 is read out of address 1 of the attribute copy table 26, and is loaded into the attribute register 48.

Next, the microprocessor 4 instructs the pointer 10 to load the address of the second memory location of the start address table 24 and also instructs the selection circuit 8 to pass the output of the AND gate 11. At this time, since a horizontal synchronizing signal is generated by the column counter 18, the content of the pointer 10 is transmitted to the refresh memory 2, thereby the start address A1 of the row 1 of the data storage area 22 is read out of the second memory location of the start address table 24, and is loaded in the address counter 12. At this time, the selection circuit 8 receives an instruction from the microprocessor 4 to transmit the output of the address counter 12 to the refresh memory 2, thus, data $D_{1,0}$ is read out of the first memory location in row 1 of the data storage area 22 in the refresh memory 2. If this data is character data, it is loaded in the character register 46, converted into a dot pattern by the character generator 30, converted into a serial data by the parallel-serial converter 32, modified in accordance with the attribute copy byte CA1 stored in the register 48 by the video controller 34, and transmitted to the CRT 46.

If the data $D_{1,0}$ is a field attribute byte FA, it is loaded in the attribute register 48, to replace the attribute copy byte CA1 to modify the following characters.

The address counter 12 is incremented by output pulses from the character width counter 16, and data $D_1$, to $D_{1,79}$ in the row 1 is sequentially read. Character data is stored in the character register 46 for display and field attribute bytes are loaded in the attribute register 48 to replace the attribute data stored therein.

When the content of the row counter 42 changes to "1", the address converting circuit 44 outputs "2", which is transmitted through the selection circuit 8 to the refresh memory 2 in response to a selection instruction of the microprocessor 4. The content of address 2, CA2, of the attribute copy table 26 is therefore read and loaded in the attribute register 48. Then, the microprocessor 4 transmits the address of the third memory location of the start address table 24 to the pointer 10 and instructs the selection circuit 8 to transmit this address to the refresh memory 2. The start address A2 in the row 2 of the data storage area 22 is thus read out of the third memory location of the start address table 24. Then, in the similar way described above, data $D_{2,0}$ to $D_{2,79}$ in a row 2 is read.

Thereafter, data in each row is sequentially read for display. FIG. 4 shows the order in which data in row 1 through row 24 is displayed on the CRT 36.

When a screen is vertically divided, it is preferable to provide each divided screen with an individual attribute copy table. With this arrangement, the address of the attribute copy table can be derived from the value of the row counter, but the table should be addressed when the signal showing the boundary of the divided screen is being generated. This the attribute copy byte relating to the divided portion of the screen is read before reading data to be displayed.

As seen from the above description, since the display apparatus of this invention stores copy attribute data collectively in a table, the attribute copy data does not split the data groups. Therefore, searching, deleting and inserting of data in the refresh memory can be performed continuously, resulting in high data processing efficiency.

While the invention has been shown and described with reference to a preferred embodiment thereof, it will be understood by those skilled in the art that various changes in form and detail may be made without departing from the spirit and scope of the invention as defined in the following claims.

What is claimed is:

1. A digital display system comprising:

a raster scan video display device for displaying characters;

a refresh memory including a first portion for storing character data representing characters to be displayed and field attribute data representing attributes of fields of characters to be displayed; and a separate second portion, referred to as an attribute copy table, for storing solely selected field attribute data;

processing means for loading into the first portion of said refresh memory said character data in positions corresponding to the desired positions of the character on the display device, and said field attribute data in positions corresponding to the initial positions of fields of characters on the display device;

means for selecting field attribute data from the field attribute data of said first portion based on a character field carry over from one displayable line of characters to another;

means for copying said selected field attribute data into said attribute copy table in said refresh memory, each entry in the attribute copy table corresponding to the initial position of a line of characters for display within a field and being a copy of the field attribute data of the end of an immediately preceding line of characters for display within the field; and display control means for reading the character data, the field attribute data, and the copy field attribute data from the refresh store to generate lines of characters with corresponding attributes on the display device.

2. A digital display system according to claim 1, in which said refresh memory includes a start address table, and including:

means for loading start addresses, each comprising the address of data representing an initial character for display on corresponding line of characters on the display device; and addressing means for selecting, for each line of characters for display on the display device, a corresponding start address from the start address table, and for addressing the refresh memory with sequential addresses from the selected start address to retrieve character data and field attribute data for the line of characters.

3. A digital display system according to claim 2, in which said display control means includes:

a character register for registering character data from the refresh memory;

an attribute register for registering said field attribute data from the refresh memory;

character generator means coupled to receive data from the character register to generate signals for the video display device; and video control means coupled to receive said signals and to receive data from the attribute register to modify said signals in accordance with the field attribute data;

said attribute data in the attribute register remaining constant for each attribute field.

4. A digital display system according to claim 2, in which said means for selecting said field attribute data for said attribute copy table comprises:

an address register for addressing said start table;

counter means responsive to an address read from the start address table for addressing sequential locations in the first portion of the refresh memory containing character data and field attribute data; and corresponding processor means for checking data addressed from said sequential locations in the refresh store to select field attribute data stored therein and for inserting the selected field attribute data into said attribute copy table.

5. A digital display system according to claim 3, in which said display control means comprises:

a row counter, coupled to clocking means, for generating successive counts for rows of characters to be displayed on the display device;

means responsive to the counts of the row counter to address the successive locations in the copy attribute table for successive rows of characters to be displayed;

pointer means for storing an address of said start address table and;

logic means coupled to the pointer means and arranged to receive horizontal synchronizing signals for the raster scan video display device to direct the address stored in the pointer means to the refresh store to access an address from the start table in response to a horizontal synchronizing signal;

whereby for each row of characters displayed, the count in the row counter defines the address of initial attribute data and the pointer means defines the address of initial character data in the row.

6. A digital display system according to claim 5, including selection circuit means coupled to receive the outputs of said address register, said logic means, said row counter and said counter means, said selection circuit means being coupled to receive control signals from said processor means to select the outputs of said address register, said logic means, said row counter and said counter means individually.

* * * * *